US010968032B2

(12) United States Patent
Eungrasamee et al.

(10) Patent No.: US 10,968,032 B2
(45) Date of Patent: Apr. 6, 2021

(54) REFILL DEVICE FOR DISPENSING A LIQUID PRODUCT

(71) Applicant: Conopco, Inc., Englewood Cliffs, NJ (US)

(72) Inventors: Phirayut Eungrasamee, Tokyo (JP); Shizuma Hattori, Tochigi-ken (JP); Makoto Mikami, Yokohama (JP); Hideo Uematsu, Tochigi ken (JP)

(73) Assignee: Conopeo, Inc., Englewood Cliffs, NJ (US)

( * ) Notice: Subject to any disclaimer, the term of this patent is extended or adjusted under 35 U.S.C. 154(b) by 79 days.

(21) Appl. No.: 15/765,561

(22) PCT Filed: Oct. 3, 2016

(86) PCT No.: PCT/EP2016/073549
§ 371 (c)(1),
(2) Date: Apr. 3, 2018

(87) PCT Pub. No.: WO2017/060190
PCT Pub. Date: Apr. 13, 2017

(65) Prior Publication Data

US 2019/0077578 A1 Mar. 14, 2019

(30) Foreign Application Priority Data

Oct. 7, 2015 (EP) ..... 15188839

(51) Int. Cl.
*B65D 83/00* (2006.01)
*B65D 25/16* (2006.01)

(52) U.S. Cl.
CPC ..... *B65D 83/0061* (2013.01); *B65D 25/16* (2013.01); *B65D 2231/005* (2013.01); *B65D 2231/025* (2013.01)

(58) Field of Classification Search
CPC ..... B65D 83/0061; B65D 25/16; B65D 2231/025; B65D 2231/005
See application file for complete search history.

(56) References Cited

U.S. PATENT DOCUMENTS 3,223,289 A 12/1965 Bouet
4,251,032 A * 2/1981 Werding ..... B05B 1/3442 239/323

(Continued)

FOREIGN PATENT DOCUMENTS

CH 350598 11/1960
DE 1875025 7/1963

(Continued)

OTHER PUBLICATIONS

IPRP2 in PCTEP2016073549, dated Feb. 1, 2018.

(Continued)

*Primary Examiner* — Matthew W Jellett
(74) *Attorney, Agent, or Firm* — Foley & Lardner LLP

(57) ABSTRACT

A refill package for liquid products, comprising: (a) a rigid outer container comprising an inside face, an opening, and an air intake means; wherein the opening comprises a removable closure and wherein the air intake means comprises a sealable orifice and a sealing mechanism, and (b) a flexible inner body, for containing a liquid product; wherein the flexible inner body is joined to the rigid outer container around the opening.

17 Claims, 5 Drawing Sheets

(56) References Cited

U.S. PATENT DOCUMENTS

| | | | | |
|---|---|---|---|---|
| 4,627,476 | A * | 12/1986 | Wilcke | B65D 47/10 141/364 |
| 6,679,304 | B1 | 1/2004 | Vacca | |
| 6,685,691 | B1 * | 2/2004 | Freund | A61J 1/10 222/105 |
| 2002/0139441 | A1 | 10/2002 | Schonfelder | |
| 2011/0168717 | A1 | 7/2011 | Boboltz et al. | |
| 2014/0061244 | A1 * | 3/2014 | Kertels | B65D 83/0061 222/183 |

FOREIGN PATENT DOCUMENTS

| | | |
|---|---|---|
| DE | 19917530 | 2/2000 |
| DE | 202004015177 | 12/2004 |
| DE | 102008016789 | 10/2008 |
| EP | 0276097 | 7/1988 |
| EP | 0567574 | 2/1995 |
| EP | 759399 | 2/1997 |
| EP | 1348642 | 10/2003 |
| EP | 1047616 | 9/2004 |
| EP | 2832658 | 2/2015 |
| GB | 2209056 | 4/1989 |
| JP | 63191774 | 8/1988 |
| JP | 1058708 | 3/1998 |
| JP | 2002326605 | 11/2002 |
| JP | 2011073770 | 4/2011 |
| WO | WO9212926 | 8/1992 |
| WO | WO9628353 | 9/1996 |
| WO | WO9929591 | 6/1999 |
| WO | WO2015014828 | 2/2015 |
| WO | WO2016066834 | 5/2016 |

OTHER PUBLICATIONS

Search Report and Written Opinion in PCTEP2016073549, dated Nov. 7, 2016.

Search Reports and Written Opinion in EP15188839, dated Feb. 10, 2016.

Written Opinion 2 in PCTEP2016073549, dated Aug. 23, 2017.

* cited by examiner

Air
1
3
4
5
7
10
11
12

REFILL DEVICE FOR DISPENSING A LIQUID PRODUCT

FIELD OF THE INVENTION

The present invention relates to a pack for dispensing a liquid product and a method for use thereof. It has particular application as a refill pack.

BACKGROUND OF THE INVENTION

Refill products permit the repeated use of a container by refilling the contents, and have become a familiar part of life today. Many consumers choose to refill and reuse containers for a wide variety of products, including homecare and personal care products, for example, detergents such as shampoo and fabric conditioners. Refilling is also common in the food industry.

Refilling generally not only reduces the consumption of resources but also the amount of waste disposed after use of the product. Consumer demand for refill systems is increasing as environmental and economic considerations become ever more prevalent.

There are a number of packs known for dispensing liquids for use as refill packs, or suitable for use therefor.

EP2832658 discloses a dispensing container for viscous products comprising a containing body comprising a flexible side wall; a bag suitable for containing a viscous product, and arranged inside the containing body; and a closure head of the containing body comprising a supply hole for the product, with a product outlet valve for maintaining pressure for retaining the product towards the outside, and preventing the entrance of outer air into the container. The bag is an elastic bag hermetically attached by its opening to the area of the neck of the containing body, forming a first leak-tight chamber between the outer face of said elastic bag and the inner face of the side wall of the containing body. The head and the elastic bag form a second leak-tight chamber, and the containing body comprises a hole with an air inlet valve suitable for allowing air flow only from outside towards the inside of the first leak-tight chamber, in response to a depression in said first leak-tight chamber.

DE102008016789 discloses a capacity regulation container having an external container made of flexible plastic material. The head of the container is cylindrical and has a valve mechanism which allows a discharge of the fluid with only external mechanical pressure. A sealing cover is fitted which is screwed onto the cylindrical head for preventing discharge of fluid during transport by accidental pressure build-up on the wall of the capacity regulation container.

DE202004015177U1 discloses a container for a viscous fluid has an air cushion under pressure inside the outer wall. An inlet valve for the introduction of outside air into the air cushion is installed in the outer wall or in the proximity of the side lying opposite the outlet opening. The outer wall is elastically deformable and through external pressure is temporarily at least partially compressible, whereby the air cushion is put under pressure. A stop may be fitted inside the outer wall to limit its degree of compression.

EP1348642 discloses a package for dispensing a liquid product that includes an outer shell having a flexible resilient sidewall and a finish surrounding an outlet opening. An inner bag-shaped liner is disposed within the outer shell, and is unattached to the sidewall and the base wall of the outer shell so as to be collapsible with respect to the outer shell as product is dispensed from the liner. A dispensing structure is secured to the finish. An opening in the base wall of the outer shell vents the volume between the shell and the liner to the atmosphere. Product is dispensed when the sidewall is squeezed.

DE19917530 discloses a squeezable bottle consisting of an outer section and an inner refill bottle. The intermediate space can be filled up with air by means of a valve pump. The emptying is then carried out by the pressurized air cushion of the intermediate space.

EP1047616 discloses a self-emptying container for liquids, viscous, pasta, powder or granular products as well as solid products. It consists of rigid material and contains a closed pressure chamber in contact with a connector for emptying (and possibly filling) the container, and a pressurising device for pressurising the pressure chamber in order to exert a pressure within the container such that it empties via the connector. A control device may be included on the connector, or valve on said container, for emptying with exact metering or dosing.

WO9628353 discloses a laminated peel container that includes an outside synthetic resin layer having an air inlet and an inside synthetic resin layer so laminated inside the outside layer as to be capable of peeling, and only the portion of the inside layer in the proximity of the air inlet is, in advance, peeled from the outside layer. The air inlet can be formed by punching from outside the outside layer at a mouth portion of the laminated peel container and cutting only the outside layer in such a manner as to leave the inside layer. The inside layer peeled partially in advance from the outside layer may be left swelling inward. The inside layer is preferably shaped from a synthetic resin having a bending modulus of not greater than 10,000 kg/cm.

EP0567574 discloses a blow-molded, multilayer container and a preform having a unitary molded structure with separable inner and outer layers and vents. The container has an integral body with an inner layer which readily separates from an outer layer and collapses to dispense a product from the container by application of positive or negative pressure.

U.S. Pat. No. 3,223,289 discloses a dispensing assembly comprising a container; a deformable wall within the container defining two separate spaces therein, one of said spaces being fillable with material; a dispensing aperture connecting said one space with the exterior; means operable from the exterior of said assembly for deforming said deformable wall; first and second vents connecting the other space with the exterior; a check valve associated with the first vent to oppose outward air flow there through and a check valve associated with the second vent to oppose inward air flow there through; and means selectively operable to disable said first vent whereupon operation of said wall deforming means will permit the dispensing of material from the exterior into said one space, and to disable said second vent whereupon operation of said wall deforming means will permit the dispensing of material from said one space to the exterior.

DE18 75 025 U discloses a storage and dispensing container for whiskey or the like consisting of a wooden barrel with an inserted glass or plastic piston, which is guided by at least one full and/or dispensing nozzle through the barrel wall.

US 2011/168717 A1 discloses a container for water-based paint having a housing with an open top and a seal surface extending around the open top. The housing defines a chamber and includes a vent opening open to that chamber. A flexible bag is disposed in the chamber which includes an open top with a seal formed around the open top. This seal abuts against the seal surface on the housing. A lid is attached to the housing so that the lid covers the open top of the housing and compresses the seal against the seal surface. A dispensing opening is formed in the lid. In use, paint is contained within the flexible bag within the housing. As paint is disposed through the dispensing opening, the flexible bag collapses in an amount equal to the volume of the dispensed paint. Consequently, air is not inducted into the interior of the container to compensate for the volume of the dispensed paint and the paint does not dry out.

CH 350 598 A discloses a pack consisting of a bag made partly of a film that is impermeable to liquids, and partly of a rigid supporting body that surrounds the bag on all sides and is closed with a lid. The upper end of the bag is fixed to the supporting body. The lid has an inlet opening and the supporting body has at least one aperture. This invention aims to eliminate a disadvantage of a conventional pack by pre-attached the lid to the supporting body before filling, instead of the conventional way of filling and then attaching the lid later.

However, despite the prior art, refilling can be messy and fiddly, especially for liquid products, and it can be time consuming to carry out the refill process. There are also difficulties with residual product remaining in the refill pack itself, particularly in liquids with higher viscosities. The mode of operation can also present predicaments during a refill process, as packaging often needs to be held together, squeezed or compressed all at the same time. These issues need to be addressed.

We have now found that a pack comprising a pre-extended flexible material within a rigid outer container, under negative pressure, wherein the liquid product is held within the extended flexible material, provides an automatic refill operation such that the user doesn't need to squeeze the pack, or perform a complex mechanical operation as in a conventional refill pack. Instead, the new pack of the invention enables the user to simply open a valve to allow air pressure from outside to get inside the pack. The pre-extended flexible material then returns to its original shape, under force of air, thereby ejecting the product, quickly and efficiently from the refill pack into the primary pack. Thus, refilling is carried out smoothly with no mess and minimal wastage. It is, therefore, quicker and easier to refill the product into a primary container.

Definition of the Invention

According to a first aspect of the present invention, there is provided:

A refill package for liquid products, comprising:

(a) a rigid outer container comprising an inside face, an opening, and an air intake means; wherein the opening comprises a removable closure and wherein the air intake means comprises a sealable orifice and a sealing mechanism, and (b) a flexible inner body, for containing a liquid product;

wherein the flexible inner body is joined to the rigid outer container around the opening.

According to a second aspect of the invention, there is provided:

A method of refilling a primary pack, comprising the steps of:— i) placing the refill, as defined in first aspect of the invention, onto the primary pack, such that the opening of the refill aligns with an opening of the primary pack;

ii) operating the air intake means so as to cause the flexible inner body to contract to its original size, thus expelling the liquid product into the primary pack through the aligned openings.

Optionally, the refill package may contain a liquid product.

BRIEF DESCRIPTION OF THE FIGURES

Embodiments of the invention will now be described with reference to the following non-limiting drawings in which:

FIG. 1 is a perspective view of the refill package comprising a rigid outer container (1) having a bottom wall (2) and an inside face (3), a flexible inner body (4) in pre-extended form, a removable closure (5) and an air intake means (6).

FIG. 2 is a perspective view of the refill package comprising a rigid outer container (1) having a bottom wall (2) and an inside face (3), a flexible inner body (4) in extended form (charged with a liquid product), a removable closure (5), an opening (7) and an air intake means (6).

FIG. 3A is a perspective view of the refill package during a refill operation into a primary container (8), before discharge, showing a rigid outer container (1) a flexible inner body (4) in extended form (charged with a liquid product), an opening (7) engaged with an opening (9) of the primary pack and a sealed air intake means (6) comprising a seal (10) and an orifice (11)

FIG. 3B is a perspective view of the refill package during a refill operation into a primary container (8), during discharge. The seal (10) is removed thus allowing air into the rigid outer container (1) through the orifice (11). The flexible inner body (4) is returning to its original shape thus discharging the liquid product (12) through the opening (7) and into the primary container (8).

FIG. 4 is a schematic showing the production of a filled refill package. In step A, a refill package of the invention comprises a rigid container (1), a flexible inner body (4), an opening (7) and an orifice (11). In step B, air is drawn out of the rigid outer container, causing a vacuum to form between the inside face (3) of the rigid outer container and the flexible inner body, thus causing the flexible inner body to expand. In step C, the flexible inner body is fully expanded and the orifice is sealed with a seal (10) to form a sealed air intake means. Step D illustrates the filling of the expanded flexible inner body (4) with liquid product (12) through the opening (7). In step E the flexible inner body is full with liquid product (12) and a closure is engaged with the opening (7).

FIG. 5 is a schematic showing the use of the refill package. In step A, the refill package is placed onto a primary pack (8), such that the opening (7) of the refill aligns with an opening (9) of the primary pack. The air-intake means is operated by removing the seal (10) such that air enters the rigid container. In step B, the air causes the flexible inner body (4) to contract, thus expelling the liquid product (12) into the primary pack (8). In step C, the flexible inner body (4) has returned to its original flat conformation and the liquid product (12) is now contained in the primary container (8).

DETAILED DESCRIPTION OF THE INVENTION

The Rigid Outer Container

Figure 1:
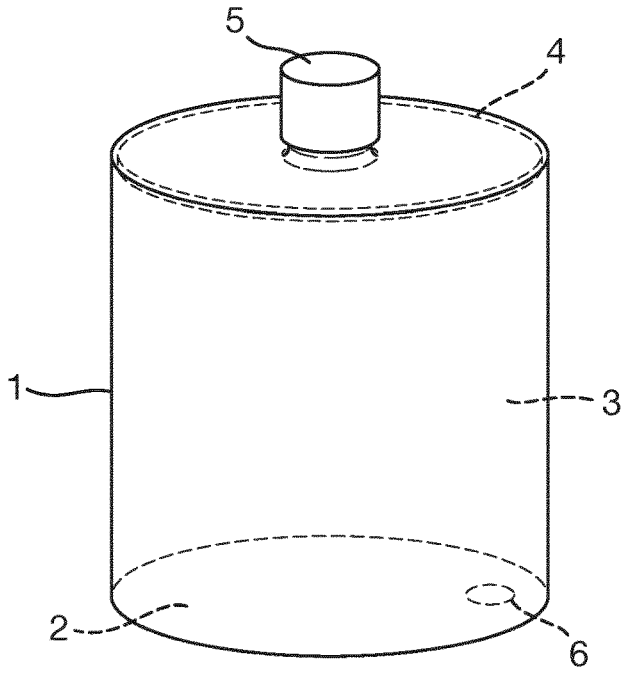
FIG. 1 is a perspective view of the refill package in accordance with the invention.
Figure 2:
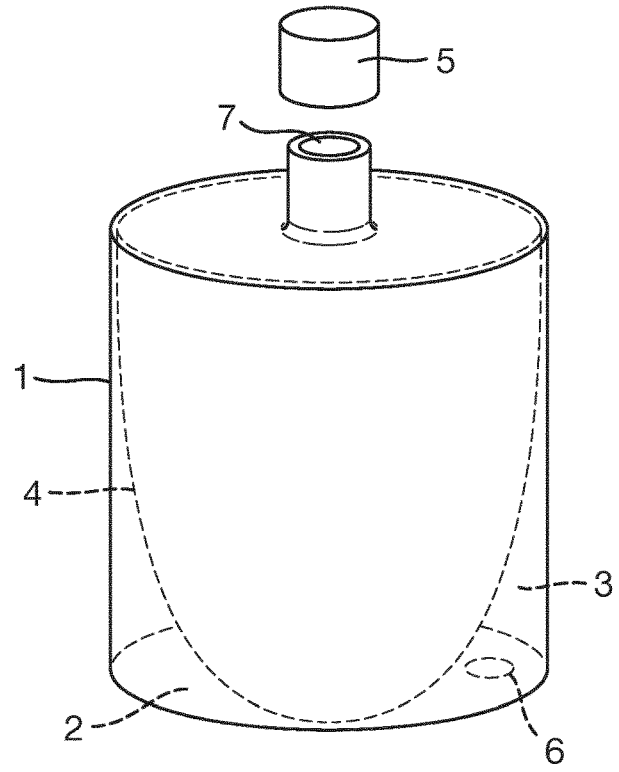
FIG. 2 is a perspective view of the refill package, charged with a liquid product, in accordance with the invention.
Figure 3A:
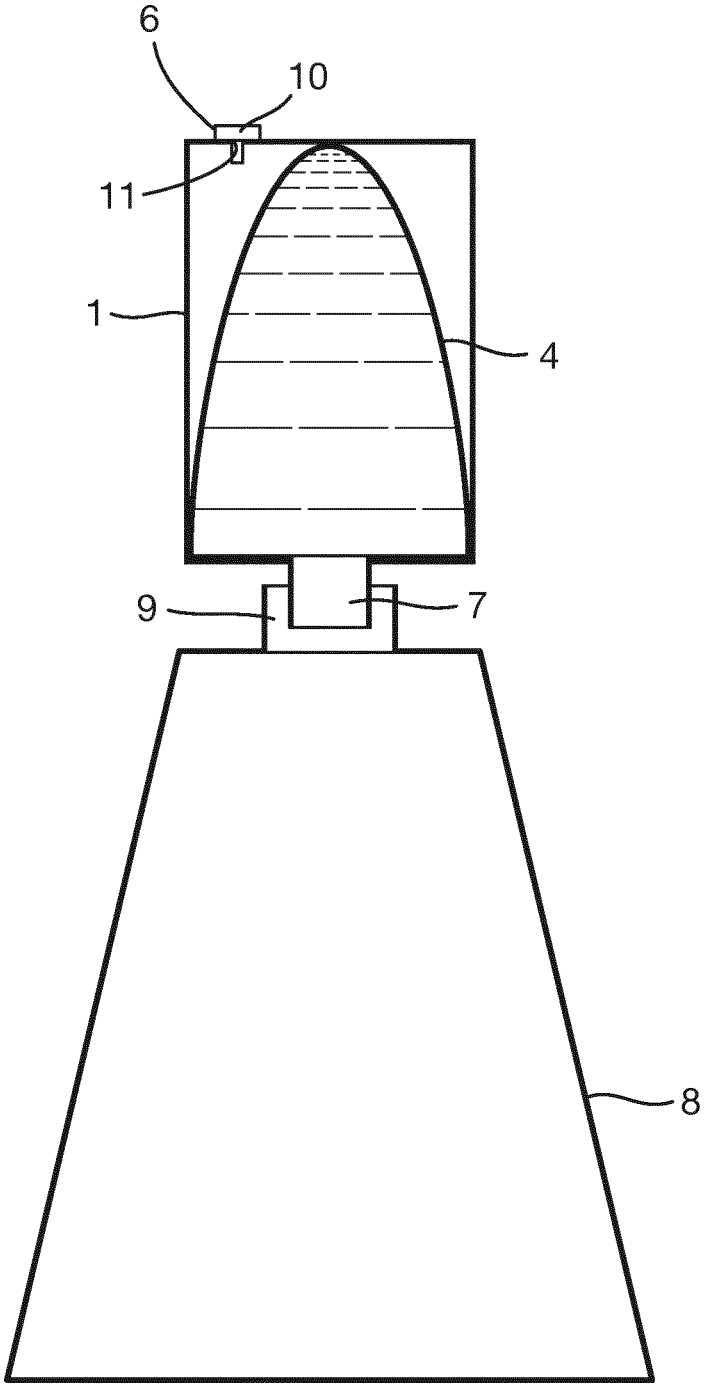
FIG. 3A is a perspective view of the refill package during a refill operation, before discharge.
Figure 3B:
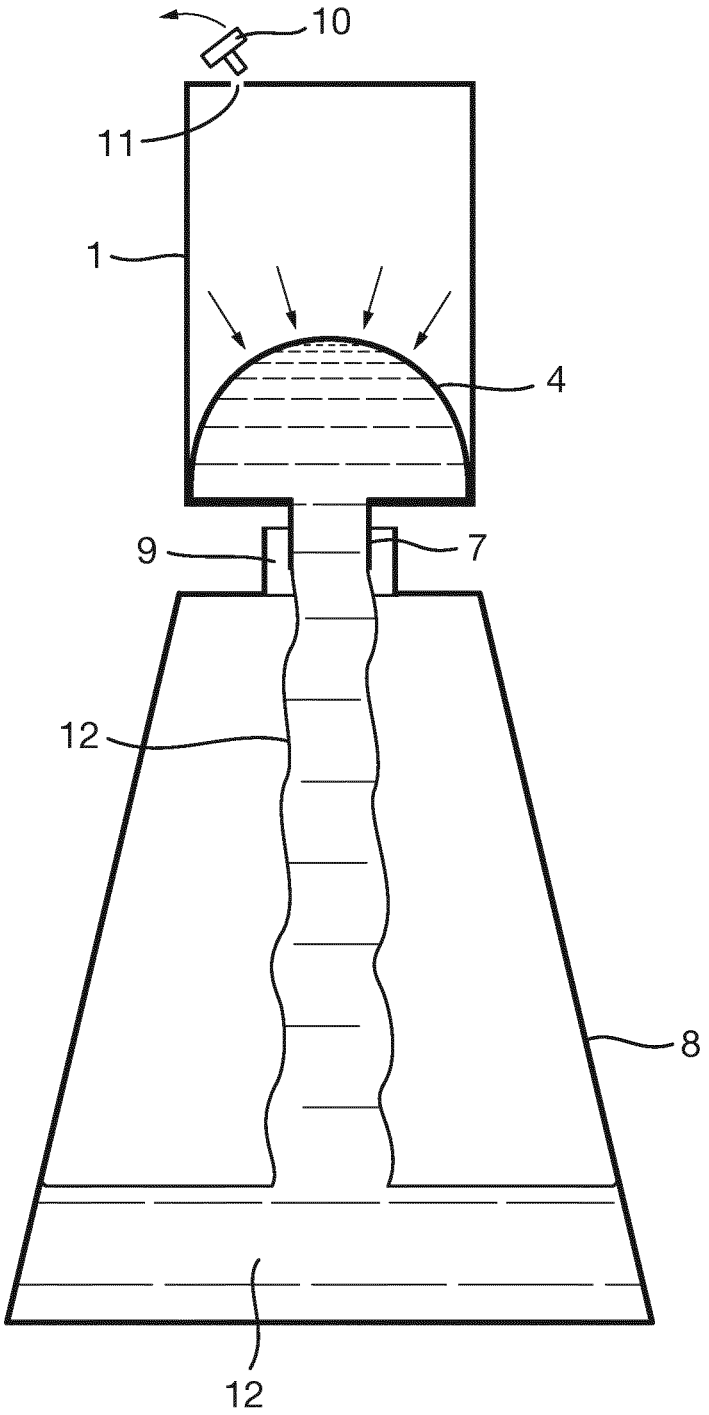
FIG. 3B is a perspective view of the refill package during a refill operation, during discharge.
Figures 4A, 4B, 4C, 4D, 4E:
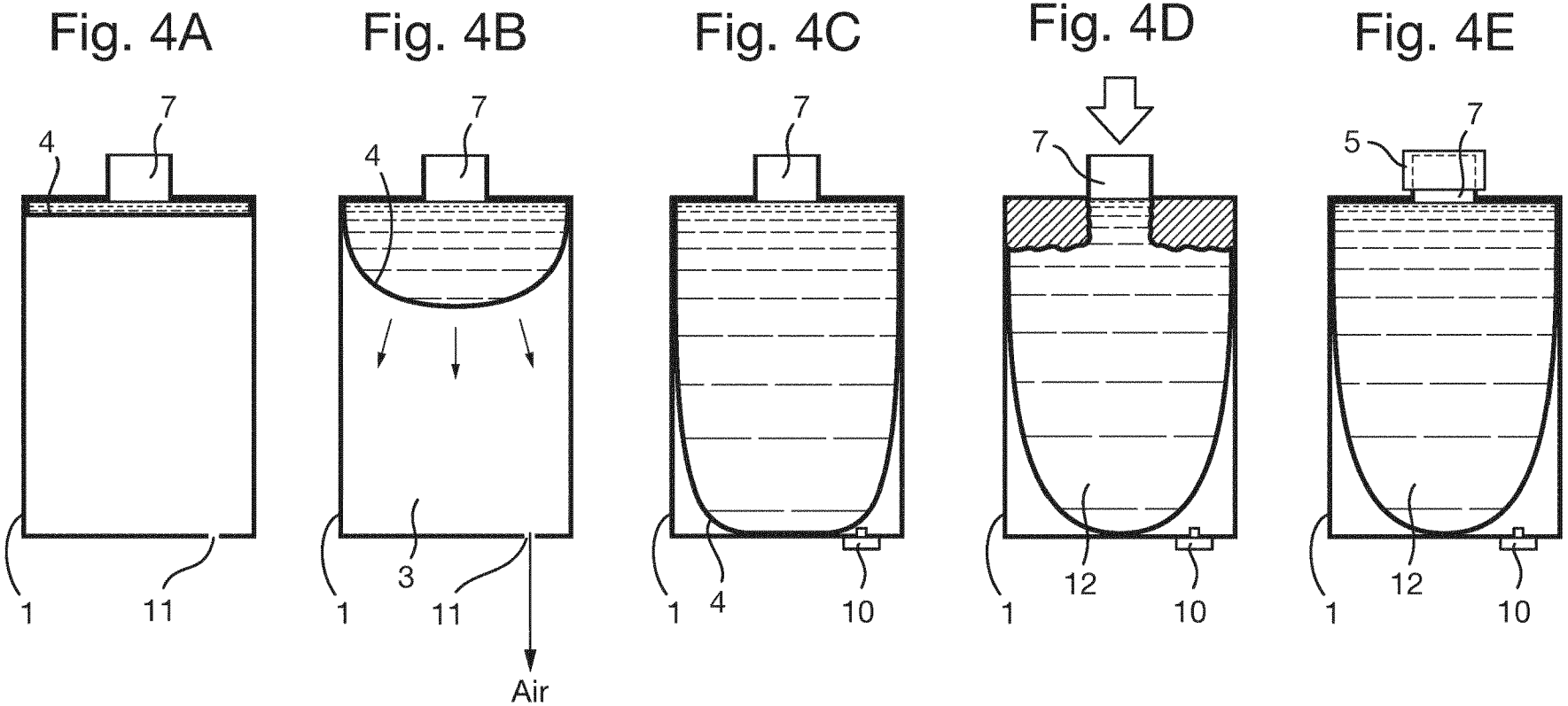
FIG. 4 is a schematic showing the production of a filled refill package.
Figure 5A:
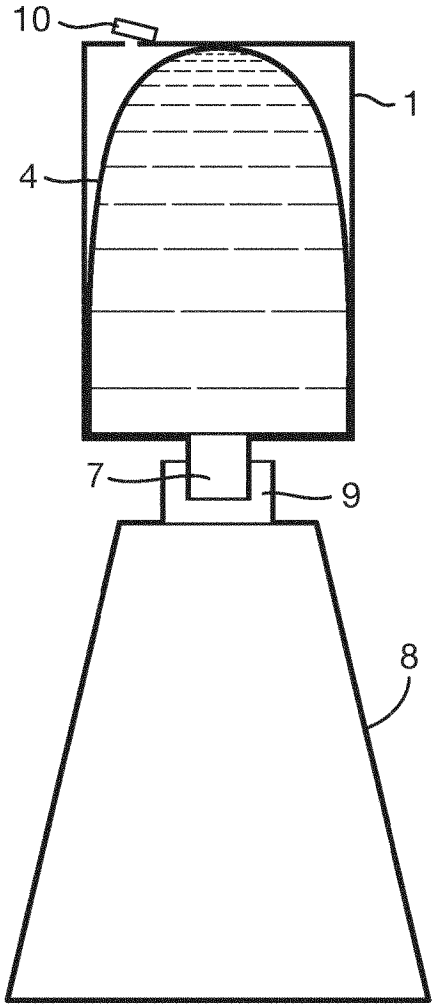
FIG. 5 is a schematic showing the use of the refill package.
Figure 5B:
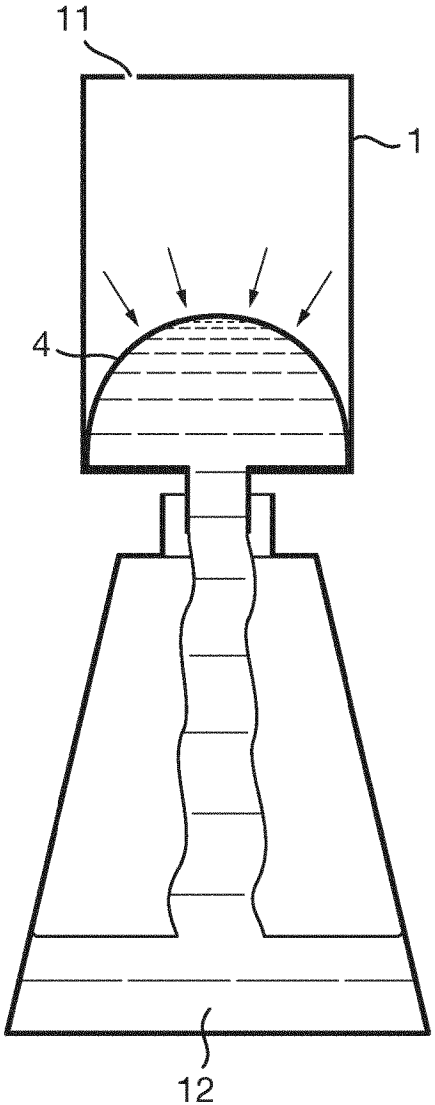
Figure 5C:
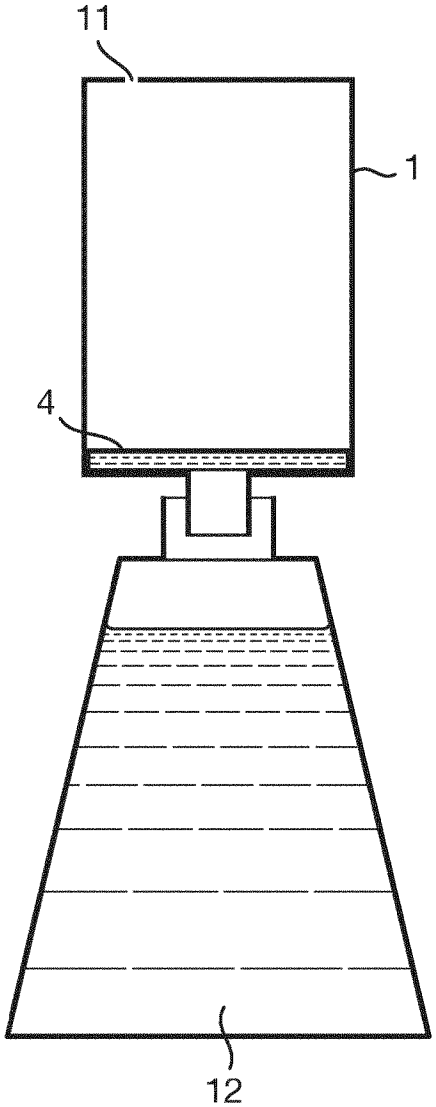

The rigid outer container comprises an inside face, an opening and an air inlet means.

The container can be any suitable shape. It preferably has a bottom wall, which is preferably flat.

In the context of the invention, by rigid is meant that it is capable of retaining the pack shape against the internal negative pressure.

The rigid outer container is made from any suitable material that is capable of retaining the pack shape against the internal negative pressure (vacuum) that is necessary for its operation, for example plastics, metal or composite packaging.

Preferred plastics can be monolayer or multi-layer and preferably include High Density Polyethylene (HDPE), Polypropylene (PP) and Polyethylene Terephthalate (PET); preferred metals include aluminum, tin and steel; preferred composite packaging includes paperboard and composite paperboard.

The opening should be of an appropriate size such that it can interface with a primary pack container in a refilling or discharging operation. In the context of the invention, by primary pack is meant a pack into which the liquid product is to be discharged. The opening has a removable closure, for example a cap or a film, preferably a cap. Preferably the cap is attached to the opening by a screw thread or a push fit.

The air intake means is located in the rigid outer container. When the container is charged with liquid, the purpose of the air intake means is to preserve the negative pressure inside the container before use and to facilitate air flow into the container upon operation during use. When the valve is operated, air flows into the rigid outer container between the flexible inner body and the inside face of the rigid outer container.

The air intake means comprises a sealable orifice and a sealing mechanism. The size of the orifice affects the air flow-rate into the container, which in turn is related to the squeezing speed during discharge of the liquid.

During preparation of the refill package air is sucked out, through the orifice, from between the flexible inner body and the rigid outer container to create a vacuum; the orifice is then sealed with the sealing mechanism to form the air intake means.

The air intake means is preferably a valve, a closure or a seal.

Suitable seals include adhesive tape or film. Such a seal, can be operated, for example, by peeling off or piercing, in order to allow air to flow into the rigid outer container.

Suitable closures include a cap, a plug, a pin, stopper, a film and so on.

Where the air intake is a valve, it has a valve component to control the intake air, for example, a rubber plug.

The air intake means can be located in any position on the rigid outer container, which provides convenience of operation to the user. It is preferably located on the bottom wall of the pack, or on the side wall near to the bottom wall, most preferably on the bottom wall.

The refill pack may have an outlet valve and/or an inner membrane for controlling liquid flow. This is particularly useful where the liquid product has a low viscosity, for example similar to that of water, which can lead to dripping. An outlet valve or inner membrane can reduce or avoid dripping.

Preferably, the refill package is a hand held refill, preferably having a capacity for the liquid product of 100 to 1000 ml, more preferably from 250 to 500 ml.

The Flexible Inner Body

The flexible inner body is suitable for containing a liquid product.

The refill package may contain a liquid product. In this case, the liquid is contained in the flexible inner body. When containing liquid, the flexible inner body assumes an extended conformation within the rigid outer container.

It is made of any elastic material that is capable of extending in response to pressure, such as when filled with liquid, and returning to its original shape when the pressure is removed, such as when the liquid is dispensed.

It can be elastic synthetic polymer or natural rubber.

The flexible inner body is joined to the rigid outer container around the opening to form an airtight seal. Thus, when the package contains liquid product, the liquid product cannot leak into the space between the inside face of the rigid outer container and the flexible inner body. During operation, the only way the liquid body can go is through the opening of the refill package.

The Liquid Product

Preferably, liquid product has a viscosity of greater than water.

Where the liquid product is a rinse-off hair conditioner, a hair mask or a leave-on conditioner composition, it suitably has a viscosity of from 5,000 to 750,000 centipoise, preferably from 50,000 to 600,000 centipoise, more preferably from 50,000 to 450,000 as measured at 30° C. on a Brookfield RVT using a Spindle A or B at 0.5 rpm for 60 seconds on a Helipath stand.

Preferably, leave-on conditioner products for use in the invention have a viscosity of from 50,000 to 250,000 centipoise; preferred hair masks have a viscosity of 150,000 to 600,000 centipoise and preferred rinse off conditioners have a viscosity of from 150,000 to 400,000 centipoise as measured at 30° C. on a Brookfield RVT using a Spindle A or B at 0.5 rpm for 60 seconds on a Helipath stand.

Where the liquid product is a shampoo, or other isotropic product, it suitably has a viscosity of from 3,000 to 100,000, preferably from 10,000 to 75,000, more preferably from 20,000 to 50,000 centipoise, as measured at 30° C. on a Brookfield RV5 at 20 rpm for 60 seconds.

Preferred liquid products include home care, personal care or food products. Examples include hair shampoo, hair conditioners, hair treatment compositions, fabric wash liquid, fabric conditioner, body wash and body care liquid. In the food sector, sauces such as mayonnaise and ketchup, and oils.

In other fields, automobile lubricant oil is a suitable liquid product.

The Method

The method of refilling a primary pack, comprising the steps of:— i) placing the refill onto the primary pack, such that the opening of the refill aligns with an opening of the primary pack;

ii) operating the air-intake means such that air enters the rigid outer container and causes the flexible inner body to contract to its original size, thus expelling the liquid product into the primary pack.

The liquid product is held within the extended flexible material under negative pressure.

The user opens the valve to allow air pressure from outside to get inside the pack. The pre-extended flexible material then returns to its original shape thereby ejecting the product, quickly and efficiently from the refill pack into the primary pack, without the need for squeezing or manipulating the container. Very little residue remains.

The invention claimed is:

1. A refill package for a liquid product, the refill package comprising:

a rigid outer container comprising an inside face, a first opening, and an air intake means operable between an open position and a closed position;

wherein the first opening comprises a removable closure and wherein the air intake means comprises a sealable orifice and a sealing mechanism, the air intake means being configured to be punctured, and a flexible inner body for containing the liquid product, the flexible inner body joined to the rigid outer container around the first opening, and the flexible inner body made of an elastic material;

wherein the rigid outer container and the air intake means facilitate contracting of the flexible inner body without application of an external pressure source and in response to the air intake means being punctured, and facilitate the flexible inner body maintaining a volume when the air intake means is in the closed position.

2. The refill package of claim 1, wherein the liquid product has a first viscosity, the first viscosity being greater than a second viscosity of water.

3. The refill package of claim 1, wherein the removable closure comprises a screw cap.

4. The refill package of claim 1, which is a hand held refill package having a liquid product capacity of 100 ml to 1000 ml, inclusive.

5. The refill package of claim 1, wherein the rigid outer container comprises a bottom wall.

6. The refill package of claim 1, wherein the air intake means comprises a seal.

7. The refill package of claim 1, wherein:

the air intake means comprises a seal; and the seal comprises at least one of: an adhesive tape or a film.

8. The refill package of claim 5, wherein the air intake means is located on the bottom wall.

9. The refill package of claim 1, further comprising an outlet valve.

10. The refill package of claim 1, further comprising an inner membrane for controlling flow of the liquid product.

11. A method of refilling a primary pack using the refill package of claim 1, the method comprising the steps of:

placing the refill package onto the primary pack such that the first opening of the refill package aligns with a second opening of the primary pack; and operating the air intake means such that air enters the rigid outer container and facilitates collapsing of the flexible inner body to discharge the liquid product into the primary pack.

12. The refill package of claim 1, wherein the flexible inner body is configured to bias the liquid product through the first opening when the air intake means is in the open position.

13. A refill package comprising:

a container defining a shape and comprising a first opening and a second opening, the second opening being isolated from an external pressure supply;

a sealing member configured to cooperate with an outer surface of the container to selectively prevent air from entering the container via the second opening, the sealing member selectively separable from the container; and an elastic body positioned within the container, coupled to the container around the first opening, cooperating with the container to establish an air tight seal around the first opening, operable between a first position and a second position, and configured to define a first volume at the first position and a second volume at the second position, the second volume larger than the first volume;

wherein the elastic body is configured to draw air into the container via the second opening to facilitate transitioning of the elastic body from the second volume to the first volume; and wherein the container is configured to maintain the shape when the elastic body: (i) is in the first position; (ii) is in the second position; and (iii) is transitioning between the first position and the second position.

14. The refill package of claim 13, wherein the elastic body is configured to be in the second position when an internal pressure between the container and the elastic body is less than an ambient pressure outside of the container.

15. The refill package of claim 14, wherein the elastic body is configured to be in the first position when an internal pressure between the container and the elastic body is equal to the ambient pressure.

16. A refill package comprising:

a container comprising a first opening and a second opening;

an elastic body disposed within the container, cooperating with the container to establish a first seal around the first opening, operative between a first body position and a second body position, having a first volume in the first body position, and having a second volume in the second body position, the second volume larger than the first volume; and a seal member operative in:

a first seal position defined by the seal member being separated from the container and the second opening, and a second seal position defined by the seal member being coupled to an outer surface of the container and preventing a flow of air into the container via the second opening;

wherein the elastic body is configured to draw air into the container through the second opening when the seal member is in the first seal position, wherein the seal member is configured to cooperate with an outer surface of the container to form a second seal around the second opening when the seal member is in the second seal position, and wherein the second opening is isolated from an external pressure supply.

17. The refill package of claim 16, wherein the elastic body is configured to transition from the second body position to the first body position when the seal member transitions out of the second seal position.

* * * * *